United States Patent [19]

Gillhaus

[11] 4,061,179

[45] Dec. 6, 1977

[54] APPARATUS FOR POURING CASTING MATERIAL

[75] Inventor: Horst Gillhaus, Dortmund-Loh, Germany

[73] Assignee: BBC Brown, Boveri & Company Limited, Baden, Switzerland

[21] Appl. No.: 722,526

[22] Filed: Sept. 13, 1976

[30] Foreign Application Priority Data

Sept. 27, 1975 Germany ..... 2543168

[51] Int. Cl.[2] ..... B22D 41/12

[52] U.S. Cl. ..... 164/151; 164/337; 222/604

[58] Field of Search ..... 164/130, 335, 337, 151; 222/168, 168.5, 604, 607

[56] References Cited

U.S. PATENT DOCUMENTS

| | | | |
|---|---|---|---|
| 3,817,318 | 6/1974 | Greenberger et al. | 164/281 |
| 3,820,769 | 6/1974 | Kishi et al. | 164/281 X |
| 3,940,021 | 2/1976 | Sillen et al. | 222/604 |

*Primary Examiner*—Robert D. Baldwin

*Attorney, Agent, or Firm*—Toren, McGeady and Stanger

[57] ABSTRACT

Casting material is delivered to molds arranged along a casting line by a pouring ladle mounting mechanism which includes a vertical column rotating about a vertical axis and a cantilever mounted at one end on the vertical column for rotation about a horizontal axis, and have a free end, opposite to the mounted end, upon which the ladle is mounted by a fork engaging outriggers on the ladle. Tilting of the ladle is effected by rotation of the cantilever and movement of the ladle through a horizontal plane is effected by rotation of the vertical column. The mechanism is transported along the casting line by a wheeled car moving on rails and a hydrodynamic sliding bearing mechanism arranged at the bottom of the vertical column acts as a weighing device to effect dosed pouring from the ladle.

8 Claims, 3 Drawing Figures

APPARATUS FOR POURING CASTING MATERIAL

BACKGROUND OF THE INVENTION

The present invention relates generally to casting apparatus and more particularly to a device for pouring casting material into molds arranged along a casting line whereby a replaceable tilting pouring ladle provided with a closable bottom outlet is mounted for movement transversely to the casting line.

In known casting machines of the type to which the present invention relates, the ladle is normally arranged in an upper car moving on rollers in a direction extending perpendicularly to the casting line. The upper car moves upon a lower car traveling along the casting line. In structures of these types presently known, the lower car is designed as a trestle and projects a substantial distance on both sides of the casting line, thereby requiring a good deal of space. Additionally, the lower car, as well as the upper car which rolls back and forth upon the lower car and which has the ladle mounted thereon, are both very heavy and rather elaborate in their construction.

Because of the great size and outer dimensions both of the upper and of the lower car, it has not been heretofore possible to charge the ladles of known casting apparatus with intermediate vessels suspended upon crane hooks.

If measuring devices are used for effecting dosed pouring of the casting material wherein it is necessary to commence from the respective filling weight of the ladle, the weighing devices utilized have tended to be very elaborate because several pressure gauges and a parallel guide for the ladle have been required wherein the ladle rests in two pivot bearings and a support.

In practice it has also been found that weight determinations have been too inaccurate with these known measuring devices, particularly due to vibrations of the entire machine thereby tending to impede casting with automatic dosing.

The present invention is intended toward providing a solution of the problems arising with the prior art devices, and the invention is particularly directed to the provision of a traveling casting machine which requires less space then presently known models, which can be placed laterally adjacent casting lines of any design, and which may also be supplied from an intermediate ladle moving on the floor of a foundry facility with known conventional means being utilized independent of a crane, since the need for upper and lower cars may be eliminated.

SUMMARY OF THE INVENTION

Briefly, the present invention may be described as casting apparatus for delivering casting material to mold means arranged along a casting line comprising transport means for moving the apparatus along a path extending generally parallel to the casting line, ladle means adapted to have the casting material stored therein for delivery to the mold means through a bottom opening therein, a vertical column mounting for rotation about a vertical axis, a cantilever mounted at one end on the vertical column for rotation about a horizontal axis and having a free end opposite thereto, fork means on the free end of the cantilever and outrigger means on the ladle adapted to engage the fork means for mounting the ladle thereon. The transport means comprise a pair of rails and a car guided along the floor of the foundry upon the rails for moving the ladle along the casting line.

In order to permit fully mechanized operation of the casting apparatus, the invention provides the car with drive means for its longitudinal movement, and the vertical column is provided with a swivel drive while the cantilever is provided with a tilting mechanism.

The ladle includes a closable bottom outlet from which the casting material is poured and is generally subject to a great deal of wear. In order to insure that the ladle may be lifted out of its receptacle when it is worn out and when it must be replaced by a new ladle, the invention provides an arrangement wherein the fork means are provided with prongs which are arranged at a suitable interval parallel to each other and which are adapted to recesses in the outriggers on the ladle in order to facilitate mounting and removal of the outriggers upon the prongs of the fork means.

By a further aspect of the present invention, a pressure sensitive weighing means is arranged at the bottom of the vertical column between this column and the car upon which the apparatus is mounted. The pressure sensitive weighing means operates to enable reproducible dosed pouring from the ladle of the casting material by utilization of a weighing device connected to computer means.

Since only a single pressure chamber is required to effect the weighing function of the pressure sensitive weighing means and since a bearing is also required for axial support of the column upon the traveling car, the pressure sensitive weighing means according to the present invention is designed to include a hydrodynamic sliding bearing.

To insure that the hydrodynamic sliding bearing may also be used for the vertical adjustment of the ladle by the simple expedient of increasing the amount of pressure fluid within the bearing, the neck of the hydrodynamic sliding bearing is adapted with regard to its height dimension to the length of the stroke of the ladle.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
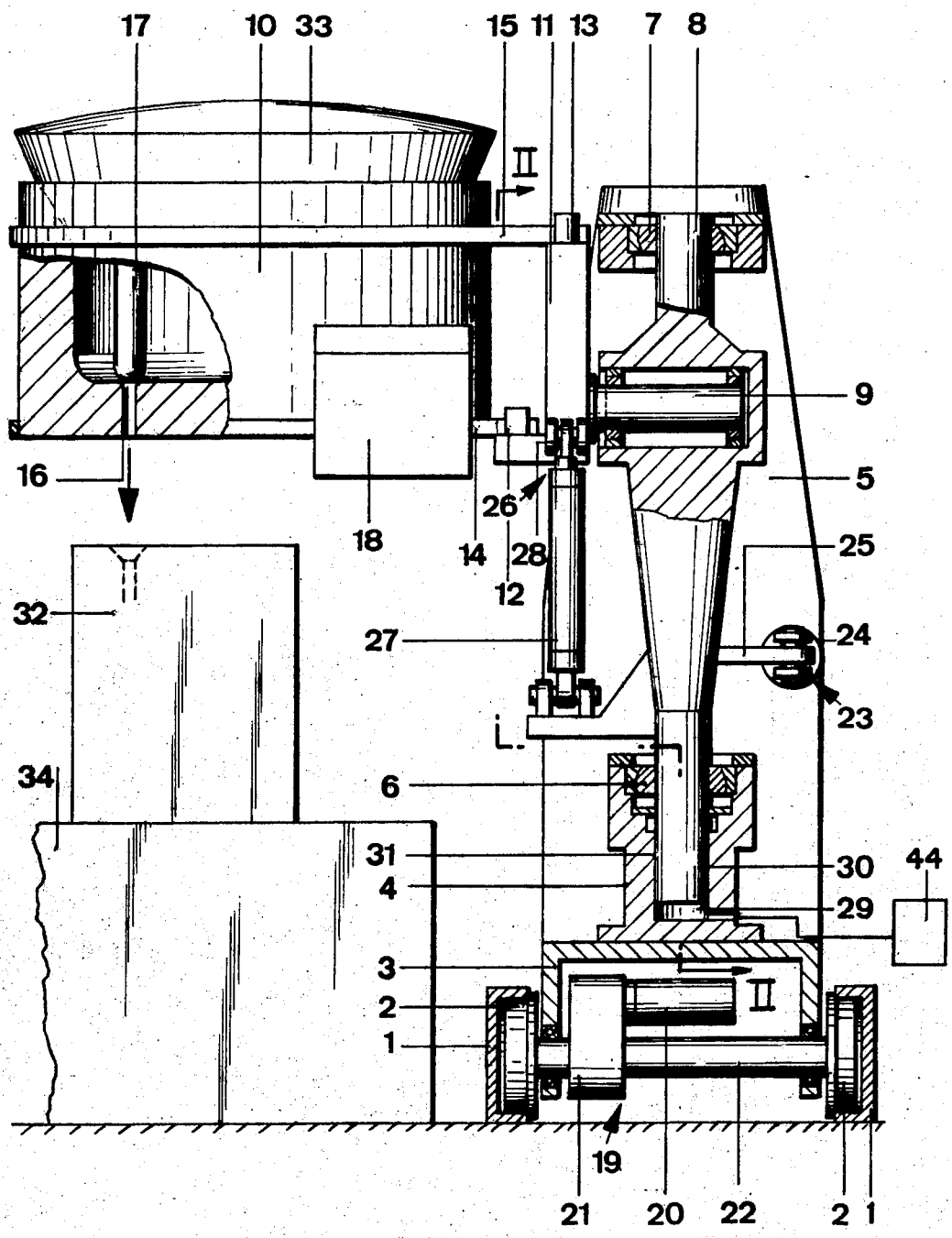
FIG. 1 is a side elevation partially in section showing the overall casting apparatus of the present invention.

Referring now to the drawings, wherein like reference numerals refer to similar parts throughout the various figures thereof, the apparatus of the invention is arranged to be mounted upon the floor of a foundry wherein there are provided a pair of generally U-shaped rails 1 which are arranged relative to each other on opposite sides of a traveling line in mirror-image fashion and which may receive therein a pair of wheels 2 upon which a car 3 is mounted with the wheels 2 being engaged within the rails 1 to enable longitudinal movement of the car 3 and the apparatus mounted thereon in directions perpendicular to the drawing of FIG. 1 while preventing tipping of the apparatus which extends vertically thereabove.

The car 3 includes a lower part 4 and an upwardly extending side portion 5 which have mounted thereon, respectively, lower pivot bearings 6 and upper pivot bearings 7 each adapted to receive a vertical column 8 which is rotatable about a vertical axis.

The column 8 carries thereupon a cantilever 9 which is mounted for rotation about a horizontal axis. The cantilever 9 has, on its free end, a fork 11 which is arranged to receive the ladle 10. The fork 11 is provided with prongs 12 and 13 which extend parallel to each other but which are arranged at different levels. The ladle is equipped with outriggers 14 and 15 which are secured on the ladle and which operate as carrying means therefor. The outriggers 14 and 15 have formed therein recesses which are adapted to become engaged upon the prongs 12 and 13 in order to mount the ladle upon the fork 11. The prongs 12 and 13 are simple journal devices and the outriggers 14 and 15 have the recesses therein formed as bores so that the outriggers 14 and 15 may be simply attached upon the journals or prongs 12 and 13 without additional fastening means and they may be securely held thereon during operation of the apparatus.

The apparatus of the invention includes a ladle 10 which has a bottom outlet 16 and a plug 17 operating to open and close the bottom outlet 16. Additionally, the ladle is equipped with heating means such as a channel or trough inductor 18, arranged in the ladle 10 with the inductor or heating means 18 operating to maintain the melt of the casting material within the ladle 10 at a constant temperature during pouring.

Of course, other known heating means may be used in place of the inductor 18 as will be apparent to those skilled in the art.

Drive means 19 are provided to effect longitudinal movement of the car 3 along the rails 1 with the drive means 19 consisting of a motor 20 adapted to cause rotation of an axle 22 and of the wheels 2 mounted thereon, with a transmission 21 being provided between the motor 20 and the wheels 2.

In order to effect rotation of the column 8 about its vertical axis, a pivot bearing 23 is provided. The pivot bearing includes as driving means therefor a differential cylinder 24 which is arranged upon the side member 5 of the car 3 with the cylinder 24 having a piston rod which is articulated with a lever 25 rigidly secured upon the column 8. As will be apparent from FIG. 3, extension and retraction of the piston rod within the cylinder 24 will cause movement of the lever 25 thereby effecting rotation of the column 8 about its vertical axis.

Figure 2:
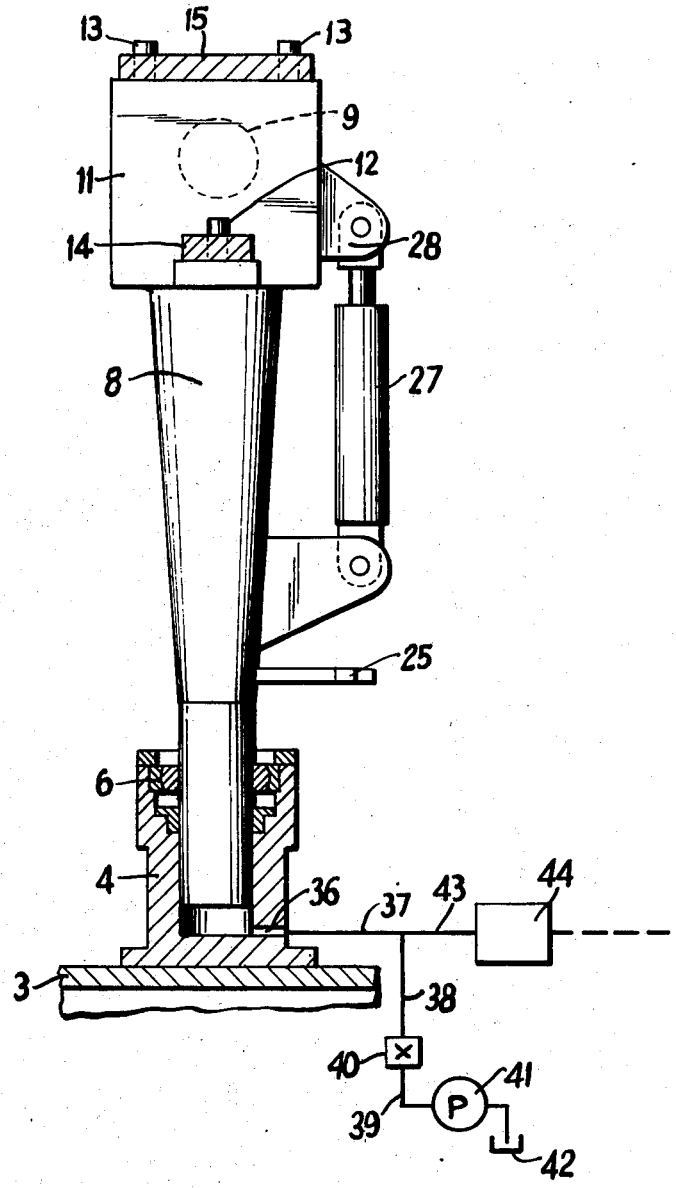
FIG. 2 is a sectional view taken along the line II—II of FIG. 1 showing in more detail part of the apparatus of the invention.

The cantilever 9 is equipped with a tilting mechanism 26 which consists of a hydrodrive mechanism 27 secured upon an outrigger of the column 8. As best seen in FIG. 2, this drive mechanism is connected with a lever system 28 interposed between the cantilever 9 and the hydrodrive 27 and by operation of the hydrodrive 27 it will be apparent that a driving force will be imparted through the lever system 28 to the cantilever 9 to cause rotation thereof about its horizontal axis.

At the bottom of the column 8 there is provided a pressure chamber 29 which consists of a hydrodynamic sliding bearing 30 upon which the column 8 bears and which at the same time provides mechanical support for the various parts thereof.

The sliding bearing 30 includes a neck 31 which is dimensioned with a height corresponding to the height difference by which the ladle 10 may be raised from its bottom position by introduction of increased amounts of pressure medium within the bearing 30 in order to enable adjustment of the proper length of the casting jet issuing from the bottom opening 16 so that the device may be adapted for differently dimensioned mold boxes 32 arranged along a casting line 34.

The hydrodynamic sliding bearing 30 is in a practical sense an axial bearing and supports the column 8 by bearing of the column 8 upon an oil cushion of the bearing 30. In other words, the hydrodynamic bearing 30 is an upright single-action cylinder with the column 8 acting as the piston thereof.

Due to the oil which is introduced into the pressure chamber 29 of the bearing 30, an upward force is applied to the column 8, and the column is moved upwardly in one direction. When oil is drained therefrom, the weight of the column 8 with its parts causes a return movement. In FIG. 1, the oil cushion is provided in pressure chamber 29 and as will be seen in FIG. 2, there is provided a bore 36 through which oil is introduced under pressure by means of a pump 41 into the hydrodynamic sliding bearing 30 through lines 37-39. The valve 40 is opened to permit the introduction of oil therethrough or oil may be drained from the hydrodynamic bearing through the valve 40 into an oil tank 42.

Connected to the line 37 over an additional line 43 is a pressure sensitive transducer 44 which converts mechanical pressure from the pressure chamber 29, into corresponding electrical signals. The pressure chamber 29, the hydrodynamic sliding bearing 30 and the pressure sensitive transducer 44 are all arranged to form pressure sensitive weighing means which operates to produce the electrical signal as representative of the downward pressure applied by the column 8 reflecting the weight of the material within the ladle 10. These signals are not used for the casting method but are applied in order to correct the height of the plug 17 above the bottom outlet 16 at different states of filling of the ladle 10 which result in different hydrostatic pressures in casting with a falling casting jet.

With the casting device in accordance with the present invention it becomes possible by using only one pressure chamber 29, which is formed by the hydrodynamic sliding bearing 30, to monitor the weight of the ladle continuously if known measures are used. With the hydrodynamic sliding bearing 30 it is also possible to vary the vertical position of the ladle 10. The column 8 rotating about its vertical axis is guided in the pivot bearings 6 and 7 and the tilting forces originating from the ladle 10 are absorbed by these bearings.

Tilting of the ladle 10 is effected by the differential cylinder 27 which is supported upon the column 8. By means of the tilting mechanism 26, 27 the ladle 10 may be moved from the position represented in the drawings and particularly in FIG. 1 and rotated about the horizontal axis of the cantilever 9. Depending upon whether the slag is to be discharged after the lid 33 has been removed, the bottom outlet 16 with its plug 17 may be utilized or replaced, or the trough inductor 18 may be changed.

Figure 3:
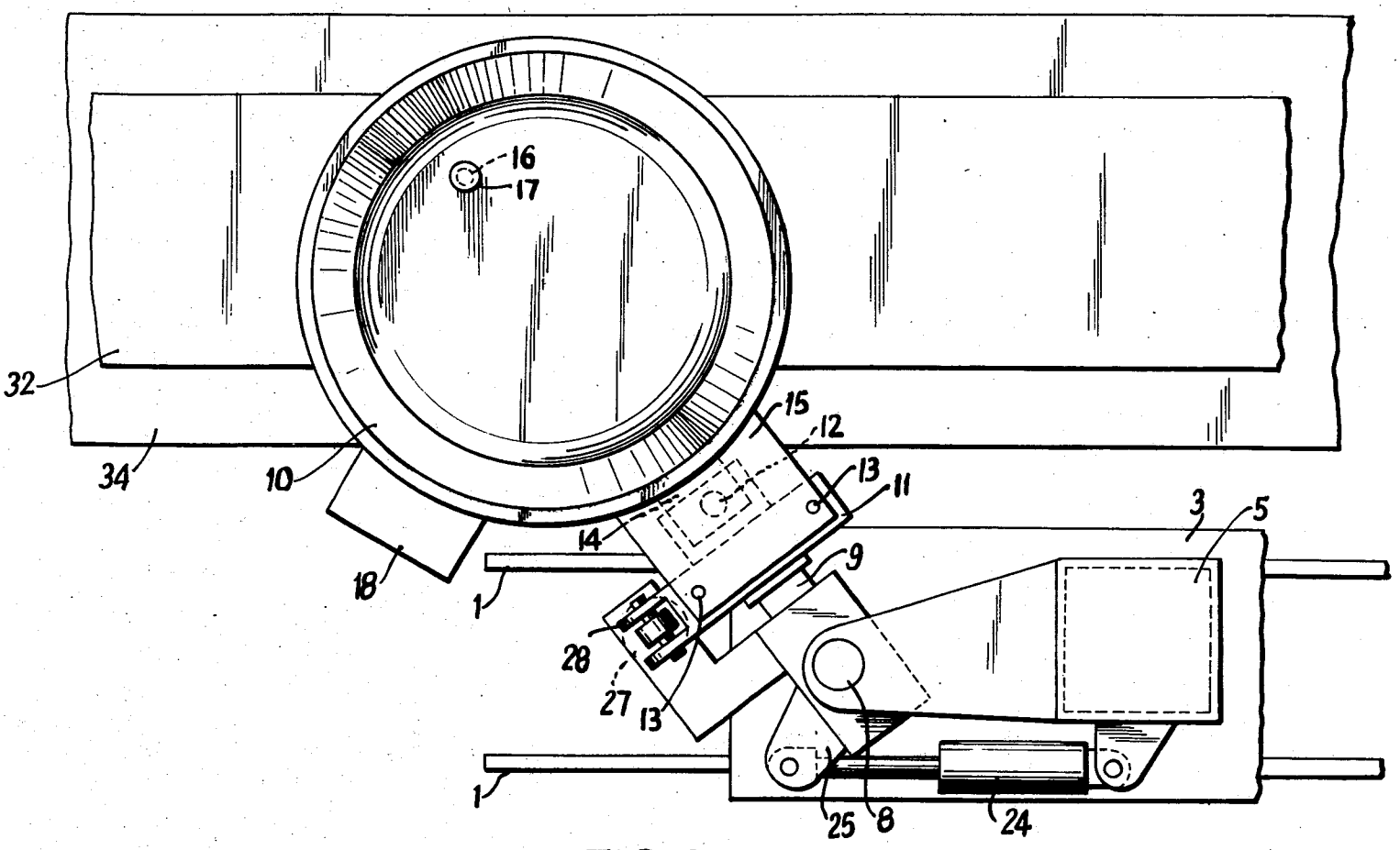
FIG. 3 is a top view of the apparatus showing the ladle of the apparatus with the cover removed and depicting the relative movement through a horizontal plane of the ladle.

Thus, as will be apparent from both FIGS. 1 and 3, the ladle 10 may be raised and lowered by operation of the hydrodynamic sliding bearing by raising and lowering the column 8. Additionally, by operation of the turning device 24, the column 8 may be rotated about its vertical axis in order to move the ladle 10, particularly as seen in FIG. 3, a relative to the casting line. When rotation of the ladle 10 about a horizontal axis is to be effected, the cylinder 27 may be operated in order to rotate the cantilever 9 thereby rotating the cylinder. Additionally, movement of the cylinder along the casting line 34 may be accomplished by movement of the car 3 along the rails 1.

The casting apparatus of the present invention is arranged along a casting line such as the casting line 34. Such a casting line may consist of a known conveyer device upon which there may be movably arranged mold boxes 32 or other devices for boxless casting. An arrow is shown to indicate the direction of the melt issuing from the ladle 10 to the bottom outlet 16 which is formed as a casting jet.

Advantages achieved with the present invention involve reduction of manufacturing costs which tend to be much less for the casting machine of the present invention than for machines known heretofore. The apparatus of the invention may be installed alongside any casting line and it may be filled from an intermediate vessel moving upon the floor of the foundry. Furthermore, the filling weight of the residual amount of the melt in the ladle may be determined exactly with the present invention after each casting.

While a specific embodiment of the invention has been shown and described in detail to illustrate the application of the inventive principles, it will be understood that the invention may be embodied otherwise without departing from such principles.

I claim:

1. Casting apparatus for delivering casting material to mold means arranged upon a casting line comprising transport means for moving said apparatus along a path extending generally parallel to said casting line, ladle means adapted to have said casting material stored therein for delivery to said mold means, a vertical column mounted for rotation about a vertical axis, a cantilever mounted at one end thereof on said vertical column for rotation about horizontal axis and having a free end at the opposite end thereof, fork means on said free end of said cantilever, and outrigger means on said ladle adapted to engage said fork means for mounting said ladle upon said fork means, said vertical column being arranged to extend vertically upwardly from said transport means, said apparatus further including pressure sensitive weighing means arranged to extend to between the lower part of said column and said transport means.

2. Apparatus according to claim 1 wherein said transport means comprise a car including wheels guided upon a pair of rails extending along said casting line.

3. Apparatus according to claim 1 further including drive means for said transport means to effect longitudinal movement thereof along said casting line, a pivot drive for said vertical column, and a tilting mechanism for said cantilever.

4. Apparatus according to claim 1 further including prongs extending from said fork means provided at suitable intervals and arranged parallel to each other, said outriggers of said ladle including recesses adapted to the arrangement of said prongs and operating to engage said prongs to mount said ladle upon said fork means.

5. Apparatus according to claim 1 wherein said pressure sensitive weighing means includes a hydrodynamic sliding bearing.

6. Apparatus according to claim 5 wherein said hydrodynamic sliding bearing includes a vertically extending neck portion having a height which is adapted to the length of the stroke of said ladle when said ladle is moved vertically during said casting operation.

7. Apparatus according to claim 6 wherein said hydrodynamic sliding bearing is adapted to raise and lower said vertical column thereby to raise and lower said ladle.

8. Apparatus according to claim 6 wherein said hydrodynamic sliding bearing comprises an upwardly extending cylindrical portion with said vertical column being arranged within said cylindrical portion as a piston thereof, said vertical column acting as a piston being movable vertically upwardly and downwardly by introduction and removal of pressure fluid to and from, respectively, said hydrodynamic sliding bearing.

* * * * *